US010407956B2

(12) United States Patent
Zhu et al.

(10) Patent No.: US 10,407,956 B2
(45) Date of Patent: Sep. 10, 2019

(54) METAL CABINET WITH ELECTRICALLY CONDUCTIVE HINGES

(71) Applicant: ZHONGSHAN FULSUN HOME IMPROVEMENT CO., LTD., Zhongshan (CN)

(72) Inventors: Ling Zhu, Zhongshan (CN); Maolin Lu, Zhongshan (CN)

( * ) Notice: Subject to any disclaimer, the term of this patent is extended or adjusted under 35 U.S.C. 154(b) by 0 days.

(21) Appl. No.: 16/166,163

(22) Filed: Oct. 22, 2018

(65) Prior Publication Data

US 2019/0055764 A1 Feb. 21, 2019

Related U.S. Application Data

(63) Continuation of application No. PCT/CN2017/077737, filed on Mar. 22, 2017.

(30) Foreign Application Priority Data

May 27, 2016 (CN) ..... 2016 2 0502001 U

(51) Int. Cl.
*E05D 11/00* (2006.01)
*F21V 23/00* (2015.01)
(Continued)

(52) U.S. Cl.
CPC ..... *E05D 11/0081* (2013.01); *E05D 3/142* (2013.01); *E05D 11/00* (2013.01);
(Continued)

(58) Field of Classification Search
CPC ... A47B 67/005; E05D 11/0081; E05D 11/00; F21V 23/001; F21V 33/0012
See application file for complete search history.

(56) References Cited

U.S. PATENT DOCUMENTS 5,727,960 A * 3/1998 Zehrung ..... E05D 11/0081 16/223
6,724,285 B1 * 4/2004 Zehrung ..... E05D 11/0081 335/205
(Continued)

FOREIGN PATENT DOCUMENTS

CN 2545322 Y 4/2003
CN 201763100 U 3/2011
(Continued)

OTHER PUBLICATIONS

Internation Search Report of PCT/CN2017/077737, dated Jun. 20, 2017.

*Primary Examiner* — Daniel J Rohrhoff
(74) *Attorney, Agent, or Firm* — Erson IP (Nelson IP)

(57) ABSTRACT

A metal cabinet with electrically conductive hinges comprises a cabinet body and a cabinet door that are made of an electrically conductive metal. An LED luminous body is disposed in the cabinet door, and at least two electrically conductive hinges for enabling the cabinet door to rotate relative to the cabinet body are disposed between the cabinet door and the cabinet body. Each of the hinges comprises a first hinge body and a second hinge body. The first hinge body is connected to a first electrically conducts wire connecting the first hinge body to a power supply. A first outer insulation pad is disposed between the first hinge body and the cabinet body. The second hinge body is connected to a second electrically conductive wire connecting the second hinge body to the LED luminous body. A second outer insulation pad is disposed between the second hinge body and the cabinet door.

8 Claims, 6 Drawing Sheets

(51) Int. Cl.

| | |
|---|---|
| ***F21V 33/00*** | (2006.01) |
| ***E05D 3/14*** | (2006.01) |
| ***F21Y 115/10*** | (2016.01) |
| ***A47B 67/00*** | (2006.01) |
| ***E06B 7/28*** | (2006.01) |

(52) U.S. Cl.
CPC ..... *F21V 23/001* (2013.01); *F21V 33/0012* (2013.01); *A47B 67/005* (2013.01); *E05Y 2800/106* (2013.01); *E05Y 2900/20* (2013.01); *E05Y 2900/208* (2013.01); *E06B 7/28* (2013.01); *F21Y 2115/10* (2016.08)

(56) References Cited

U.S. PATENT DOCUMENTS

| | | | | |
|---|---|---|---|---|
| 7,850,326 | B2 * | 12/2010 | Herper | A47B 97/00 362/127 |
| 9,115,518 | B2 * | 8/2015 | Herglotz | E05D 11/0081 |
| 2005/0091797 | A1 * | 5/2005 | Dillingham | E05D 3/122 16/354 |
| 2009/0313790 | A1 * | 12/2009 | Schau | E05D 3/122 16/354 |
| 2012/0285089 | A1 * | 11/2012 | Artwohl | A47F 3/0434 49/70 |
| 2013/0248662 | A1 * | 9/2013 | Herglotz | E05D 5/023 248/71 |
| 2016/0312505 | A1 * | 10/2016 | Wuerth | E05D 11/0081 |
| 2017/0181541 | A1 * | 6/2017 | Stanley, Jr. | H02J 7/025 |
| 2017/0306674 | A1 * | 10/2017 | Soloski | E05D 11/0081 |
| 2018/0142848 | A1 * | 5/2018 | Sandona' | F21S 8/036 |
| 2018/0359001 | A1 * | 12/2018 | Grosse | E05D 11/0018 |
| 2018/0361008 | A1 * | 12/2018 | Munn | A61L 9/20 |

FOREIGN PATENT DOCUMENTS

| | | | | |
|---|---|---|---|---|
| CN | 203744092 | U | 7/2014 | |
| CN | 205638004 | U | 10/2016 | |
| DE | 3510670 | A1 * | 9/1986 | A47B 67/005 |
| DE | 202014104320 | U1 * | 12/2015 | E05D 11/0081 |
| JP | 2001334892 | A | 12/2001 | |

* cited by examiner

METAL CABINET WITH ELECTRICALLY CONDUCTIVE HINGES

CROSS-REFERENCE TO RELATED APPLICATIONS

This application is a continuation of International Patent Application No. PCT/CN2017/077737 with a filing date of Mar. 22, 2017, designating the United States, now pending, and further claims priority to Chinese Patent Application No. 201620502001.0 with a filing dale of May 27, 2016. The content of the aforementioned applications, including any intervening amendments thereto, are incorporated herein by reference.

TECHNICAL FIELD

The disclosure relates to a metal cabinet, and particularly to a metal cabinet with electrically conductive hinges.

BACKGROUND OF THE PRESENT INVENTION

At present, the metal cabinets are widely applied in bathroom. The metal cabinet is usually installed on the wall, and personal hygiene products like shampoo, toothpaste, etc. are placed in the cabinet. Generally, an LED luminous body will be disposed inside the cabinet door, which can brighten the whole cabinet after electrification. Traditional cabinets realize electrification by adopting a long wire disposed in the cabinet door and the cabinet body, this design needs many fasteners, making the wiring structure complex, lowering the assembly efficiency and increasing the cost. Moreover, part of wire will be inevitably exposed at the joint of the cabinet door and the cabinet body, which is neither beautiful, nor convenient to clean.

The invention is treated for overcoming these deficiencies above.

SUMMARY OF PRESENT INVENTION

The object of the disclosure is to overcome the deficiencies in prior art and provide a metal cabinet with electrically conductive hinges, which has simple structure and low cost.

The object of the disclosure is realized by the following technical solutions:

A metal cabinet with electrically conductive hinges comprises a cabinet body and a cabinet door that are made of an electrically conductive metal; an LED luminous body is disposed in the cabinet door; at least two electrically conductive hinges for enabling the cabinet door to rotate relative to the cabinet body are disposed between the cabinet door and the cabinet body, at least one of the hinges is connected to a negative electrode of the LED luminous body, and at least one of the hinges is connected to a positive electrode of the LED luminous body; each of the hinges comprises a first hinge body fixedly connected to the cabinet body and a second hinge body fixedly connected to the cabinet door; the first hinge body is connected so a first electrically conductive wire connecting the first hinge body to a power supply; a first outer insulation pad is disposed between the first hinge body and the cabinet body; the second hinge body is connected to a second electrically conductive wire connecting the second hinge body to the LED luminous body; and a second outer insulation pad is disposed between the second hinge body and the cabinet door.

The metal cabinet with electrically conductive hinges as described above, a second electrically conductive sheet connecting to the second electrically conductive wire is disposed in the cabinet door, a second inner insulation pad is disposed between the second electrically conductive sheet and the cabinet door, the second hinge body is connected to the second electrically conductive sheet through a second fixing screw, the second fixing screw passes through the second outer insulation pad, the cabinet door and the second inner insulation pad, and the second fixing screw and the cabinet door are in non-contact state.

The metal cabinet with electrically conductive hinges as described above, an annular second wire ear is disposed to an end of the second electrically conductive wire, the second wire ear is connected to the second electrically conductive sheet through a second electrically conductive screw, the second electrically conductive screw passes through the second outer insulation pad, the cabinet door, the second inner insulation pad, the second electrically conductive sheet and the second wire ear, the second electrically conductive screw and the cabinet door are in non-contact state, and a second electrically conductive nut is engaged with an end of the second electrically conducive screw to lock the second electrically conductive sheet and the second wire ear.

The metal cabinet with electrically conductive hinges as described above, a plurality of second bulges passing through the cabinet door are defined at a side of the second outer insulation pad and are integrally formed with the second outer insulation pad; and the second fixing screw and the second electrically conductive screw are inserted into the second bulges respectively.

The metal cabinet with electrically conductive hinges as described above, a first electrically conductive sheet connecting to the first electrically conductive wire is disposed in the cabinet body, and a first inner insulation pad is disposed between the first electrically conductive sheet and the cabinet body; the first hinge body is connected to the first electrically conductive sheet through a first fixing screw, the first fixing screw passes through the first outer insulation pad, the cabinet body and the first inner insulation pad, and the first fixing screw and the cabinet body are in non-contact state.

The metal cabinet with electrically conductive hinges as described above, an annular first wire ear is disposed to an end of the first electrically conductive wire, the first wire ear is connected so the first electrically conductive screw through a first electrically conductive screw, the first electrically conductive screw passes through the first outer insulation pad, the cabinet body the first inner insulation pad, the first electrically conductive sheet and the first wire ear, the first electrically conductive screw and the cabinet body are in non-contact state; and a first electrically conducive nut is engaged with an end of the first electrically conductive screw to lock the first electrically conductive sheet and the first wire ear.

The metal cabinet with electrically conductive hinges as described above, a plurality of first bulges passing through the cabinet body are defined at a side of the first outer insulation pad and are integrally formed with the first outer insulation pad, and the first fixing screw and the first electrically conductive screw are inserted into the first bulges respectively.

The metal cabinet with electrically conductive hinges as described above, a glass mirror is disposed to the cabinet door.

Compared with the prior art, the disclosure has the following advantages:

1. The disclosure realizes electric conduction by two hinges, one is connected to the negative electrode of the LED luminous body, and the other one is connected to the positive electrode of the LED luminous body. Moreover, each hinge comprises the first hinge body fixedly connected to the cabinet body and the second hinge body fixedly connected to the cabinet door; the power supply is connected to the first hinge body through the first electrically conductive wire, the LED luminous body is connected to the second hinge body through the second electrically conducive wire, so that the power supply is electrically connected to the LED luminous body through the first electrically conductive wire, the first hinge body, the second hinge body, the second electrically conductive wire when open or close the cabinet door. Since the first outer insulation pad is disposed between the first hinge body and the cabinet body, the second outer insulation pad is disposed between the second hinge body and the cabinet door, the charged first hinge body and the second hinge body are insulated with the metal cabinet body and cabinet door, avoiding occurring the short circuit caused by the metal cabinet door and cabinet body charged. The whole structure is simple, design is ingenious, electric conduction function is realized by adopting metal hinges, to reduce the cost and facilitate assembly.

2. The second inner insulation pad is disposed between the second electrically conductive sheet and the cabinet door in the disclosure. The second fixing screw connects the second hinge body and the second electrically conductive sheet, and the second fixing screw becomes conductor to function the transmission of current. Similarly, the first inner insulation pad is disposed between the first electrically conductive sheet and the cabinet body, the first fixing screw connects the first hinge body and the first electrically conducive sheet, and the first fixing screw becomes conductor to function the transmission of current. In addition, the second electrically conductive screw passes through the second wire ear along with the engagement between the second electrically conductive screw and the second electrically conductive nut to connect the second electrically conductive wire and the second electrically conductive sheet. The first electrically conductive screw passes through the first wire ear, along with the engagement between the first electrically conductive screw and first electrically conductive nut to connect the first electrically conductive wire and the first electrically conductive sheet. The design of this structure is not only ingenious and simple, but also safe.

3. A plurality of first bulges passing through the cabinet body are defined at a side of the first outer insulation pad and are integrally formed with the first outer insulation pad in the disclosure, the first fixing screw and the first electrically conductive screw are inserted into the first bulges respectively. A plurality of second bulges passing through the cabinet door are defined at a side of the second outer insulation pad and are integrally formed with the second outer insulation pad, the second living screw and the second electrically conductive screw are inserted into the second bulges respectively. The first bulges and second bulges pass through the cabinet body and the cabinet door respectively, which presents the first fixing screw and the first electrically conductive screw from being contacted with the cabinet body and transporting charges to the cabinet body, and prevents the second fixing screw and the second electrically conductive screw from being contacted with the cabinet door and transporting charges the cabinet door, to avoid occurring short circuit and ensure the reliability of product quality.

DETAILED DESCRIPTION OF PREFERRED EMBODIMENTS

Figure 1:
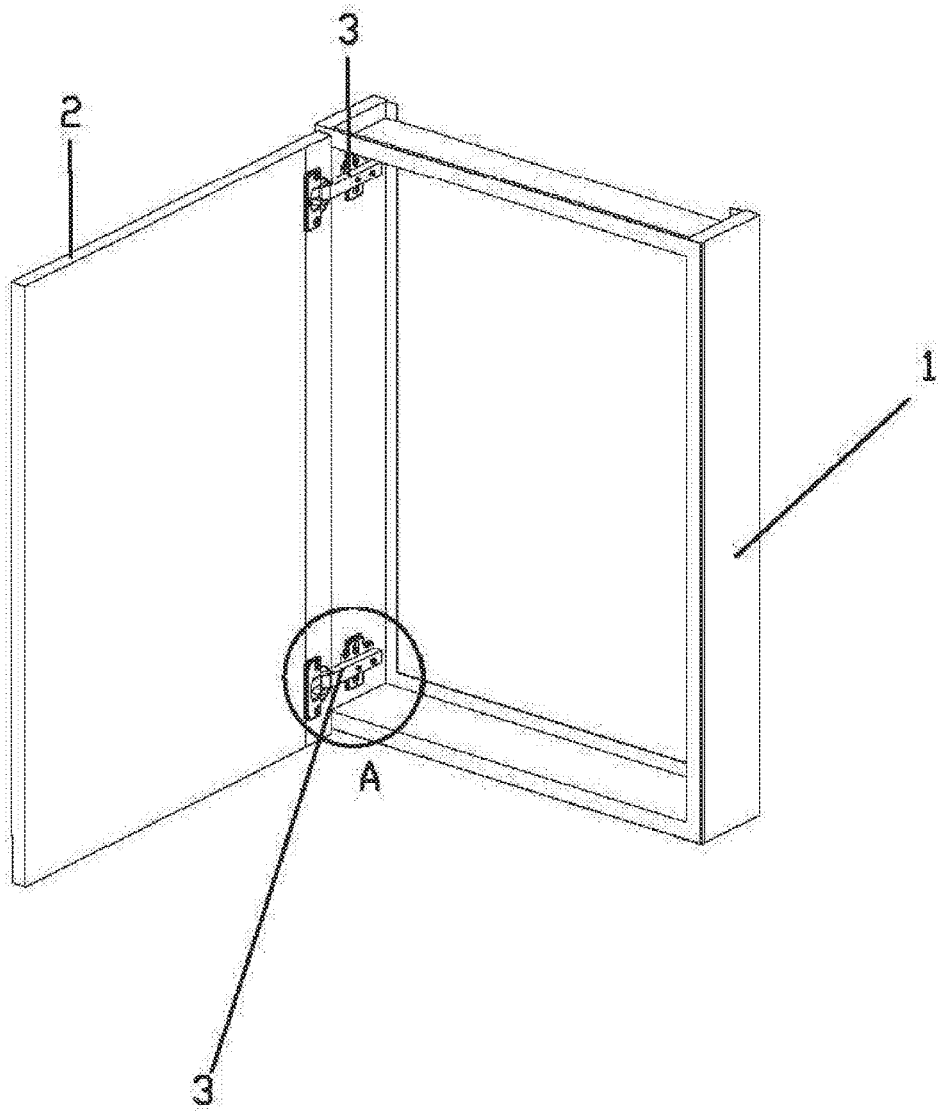
FIG. 1 is a perspective view according to the present disclosure.

The present disclosure is further described below in detail with reference to accompanying drawings.

Referring to FIG. 1 to FIG. 5, a metal cabinet with electrically conductive hinges, comprises a cabinet body 1 and a cabinet door 2 that are made of an electrically conducive metal. An LED luminous body (not showing in accompanying drawings) is disposed in the cabinet door 2. At least two electrically conductive hinges 3 for enabling the cabinet door 2 to rotate relative to the cabinet body 1 are disposed between the cabinet door 2 and the cabinet body 1, at least one of the hinges 3 is connected to a negative electrode of the LED luminous body, and at least one of the hinges 3 is connected to a positive electrode of the LED luminous body. The hinges 3 comprise a first hinge body 31 fixedly connected to the cabinet body 1 and a second hinge body 32 fixedly connected to the cabinet door 2. The first hinge body 31 is connected to a first electrically conductive wire 4 connecting the first hinge body 31 to a power supply. A first outer insulation pad 5 is disposed between the first hinge body 31 and the cabinet body 1. The second hinge body is connected to a second electrically conductive wire 6 connecting the second hinge body 32 to the LED luminous body. A second outer insulation pad 7 is disposed between the second hinge body 32 and the cabinet door 2.

Figure 2:
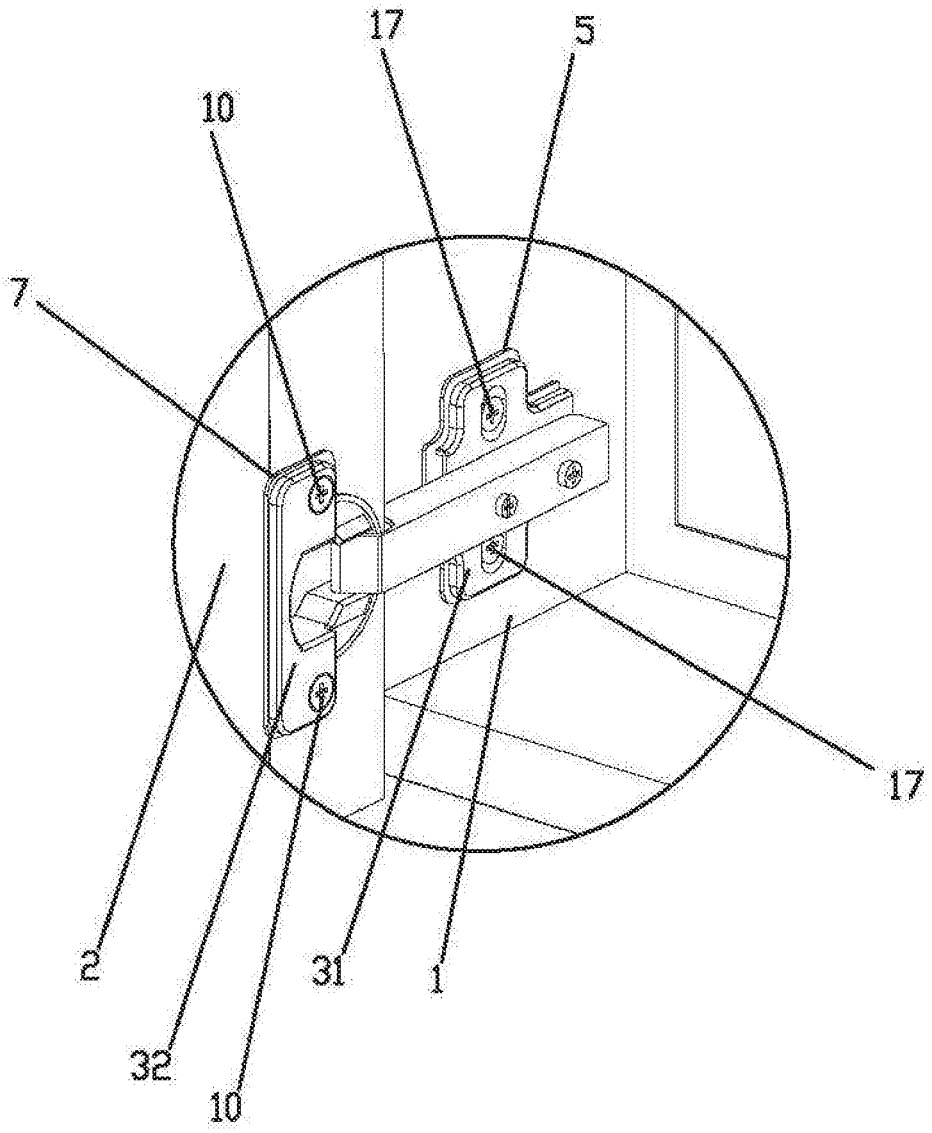
FIG. 2 is an enlarged view of portion A shown in FIG. 1.
Figure 3:
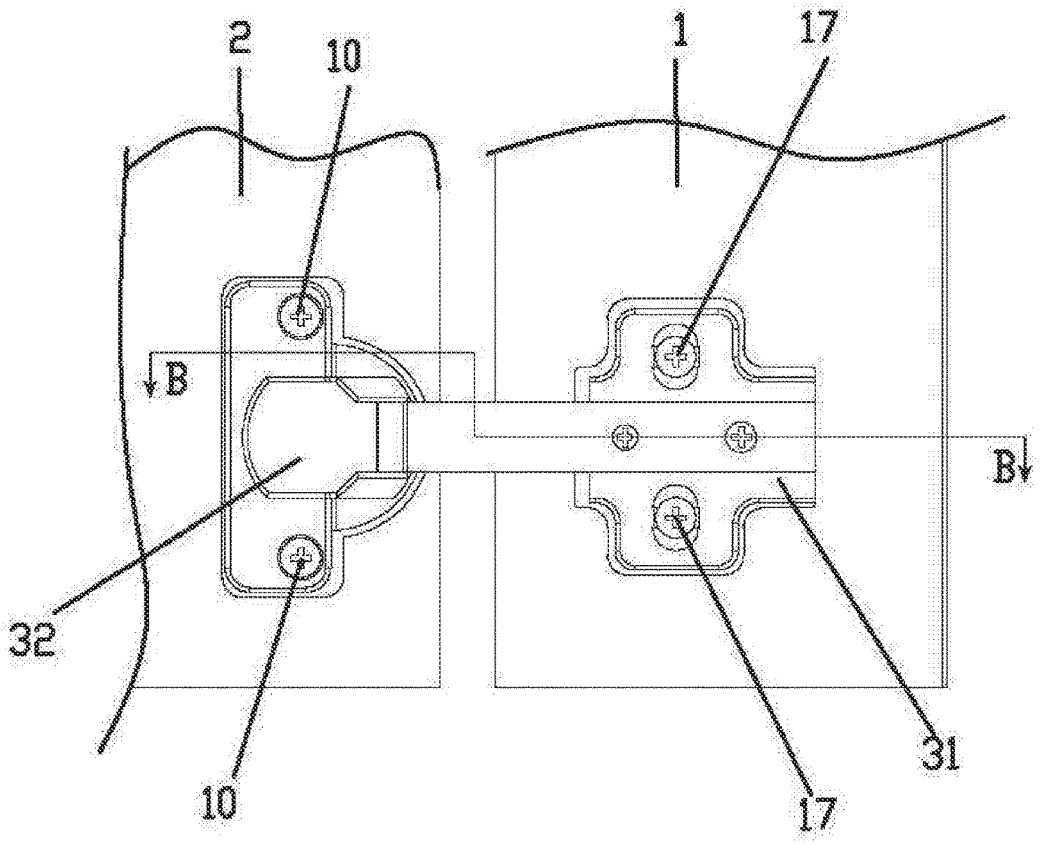
FIG. 3 is a structural diagram when opening a cabinet door.

Referring to FIG. 2 and FIG. 3, the power supply is electrically connected to the LED luminous body through the first electrically conductive wire 4, the first hinge body 31, the second hinge body 32 and the second electrically conductive wire 6 when open or close the cabinet door 2. Since the first outer insulation pad 5 is disposed between the first hinge body 31 and the cabinet body 1, the second outer insulation pad 7 is disposed between the second hinge body 32 and the cabinet door 2, the charged first hinge body 31 and the second hinge body 32 are insulated with the metal cabinet body 1 and cabinet door 2, avoiding occurring short circuit caused by the metal cabinet door 2 and cabinet body 1 charged. The whole structure is simple, design is ingenious, electric conduction function is realized by adopting metal hinges, to reduce the cost and facilitate assembly. Besides, the design avoids the exposure of wire, making the metal cabinet more simple, beautiful and convenient to clean.

Figure 4:
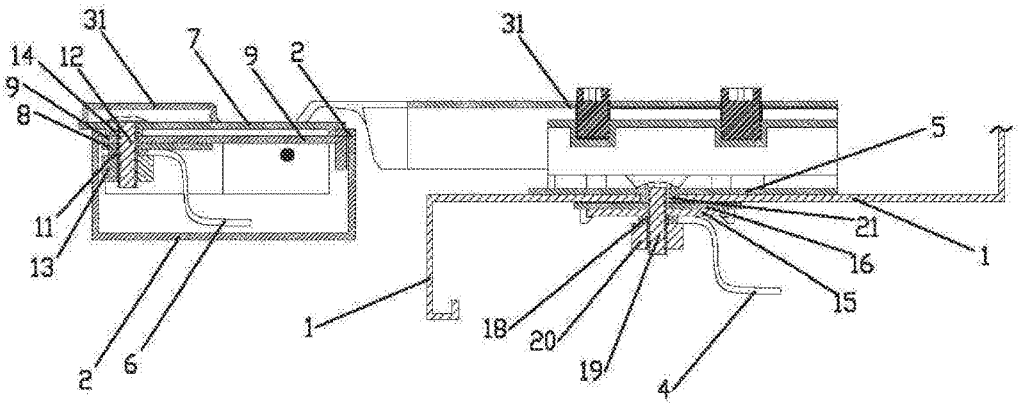
FIG. 4 is a sectional structural view along line B-B shown in FIG. 3.
Figure 5:
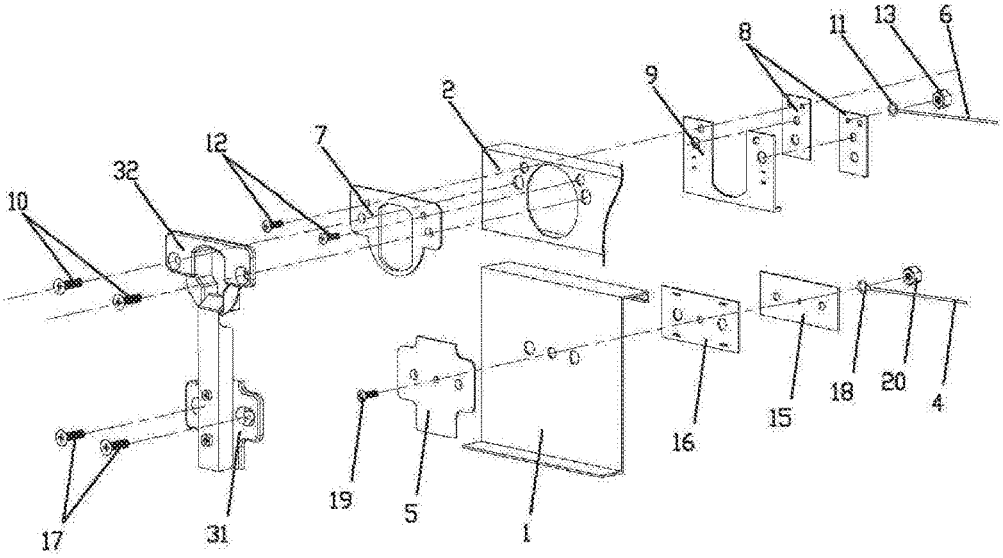
FIG. 5 is an exploded view according to the present disclosure

Referring to FIG. 4 and FIG. 5, a second electrically conductive sheet 8 connecting to the second electrically conductive wire 6 is disposed in the cabinet door 2, a second inner insulation pad 9 is disposed between the second electrically conductive sheet 8 and the cabinet door 2, the second hinge body 32 is connected to the second electrically conductive sheet 8 through a second fixing screw 10, the second fixing screw 10 passes through the second outer insulation pad 7, the cabinet door 2 and the second inner insulation pad 9, and the second fixing screw 10 and the cabinet door 2 are in non-contact state.

Referring to FIG. 4 and FIG. 5, an annular second wire ear 11 is disposed to an end of the second electrically conductive wire 6, and the second wire ear 11 is connected to the second electrically conductive sheet 8 through a second electrically conductive screw 12. The second electrically conductive screw 12 passes through the second outer insulation pad 7, the cabinet door 2, the second inner insulation pad 9, the second electrically conductive sheet 8 and the second wire ear 11. The second electrically conductive screw 12 and the cabinet door 2 are in non-contact state. A second electrically conductive nut 13 is engaged with an end of second electrically conductive screw 12 to lock the second electrically conductive sheet 8 and the second wire ear 11.

Figure 6:
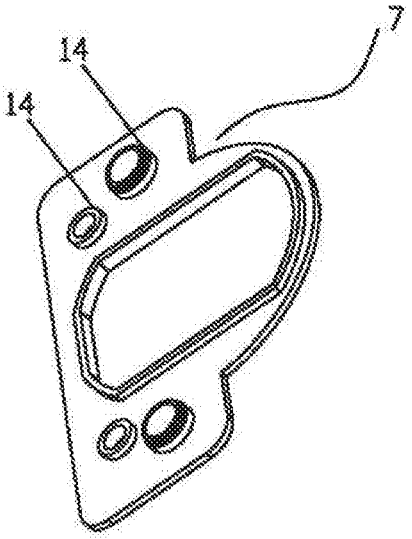
FIG. 6 is a perspective view of a second outer insulation pad according to the present disclosure.

Referring to FIG. 4 to FIG. 6, a plurality of second bulges 14 passing through the cabinet door 2 are defined at a side of the second outer insulation pad 7 and are integrally formed with the second outer insulation pad 7. The second fixing screw 10 and the second electrically conducive screw 12 are inserted into the second bulges 14 respectively.

Referring to FIG. 4 and FIG. 5, a first electrically conductive sheet 15 connecting to the first electrically conductive wire 4 is disposed in the cabinet body 1. A first inner insulation pad 16 is disposed between the first electrically conductive sheet 15 and the cabinet body 1, and the first hinge body 31 is connected to the first electrically conductive sheet 15 through a first fixing screw 17. The first fixing screw 17 passes through the first outer insulation pad 5, the cabinet body 1 and the first inner insulation pad 16. The first fixing screw 17 and the cabinet body 1 are in non-contact state.

Referring to FIG. 4 and FIG. 5, an annular first wire ear 18 is disposed to an end of the first electrically conductive wire 4, and the first wire ear 18 is connected to the first electrically conductive sheet 15 through a first electrically conductive screw 19. The first electrically conductive screw 19 passes through the first outer insulation pad 5, the cabinet body 1, the first inner insulation pad 16, the first electrically conductive sheet 15 and the first wire ear 18. The first electrically conductive screw 19 and the cabinet body 1 are in non-contact state. A first electrically conductive nut 20 is engaged with an end of the first electrically conductive screw 19 to lock the first electrically conductive sheet 15 and the first wire ear 18.

Figure 7:
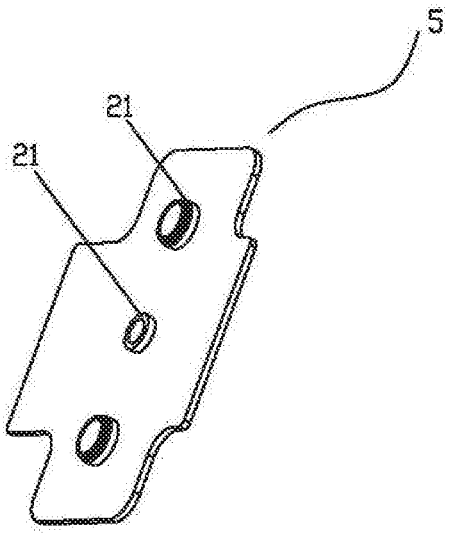
FIG. 7 is a perspective view of a first outer insulation pad according to the present disclosure.

Referring to FIG. 4, FIG. 5 and FIG. 7, a plurality of first bulges 21 passing through the cabinet body 1 are defined at a side of the first outer insulation pad 5 and are integrally formed with the first outer insulation pad 5. A first fixing screw 17 and the first electrically conductive screw 19 are inserted into the first bulges 21 respectively.

Referring to FIG. 4 to FIG. 7, the first bulges 14 and second bulges 21 pass through the cabinet body 1 and the cabinet door 2 respectively, which prevents the first fixing screw 17 and the first electrically conductive screw 19 from being contacted with the cabinet body 1 and transporting charges to the cabinet body 1, and prevents the second fixing screw 10 and the second electrically conductive screw 12 from being contacted with the cabinet door 2 and transporting charge to the cabinet door 2, to avoid occurring short circuit and ensure the reliability of product quality.

A glass mirror is disposed to the cabinet door 2, which makes it convenient for user to dress up.

We claim:

1. A metal cabinet with electrically conductive hinges, comprising a cabinet body (1) and a cabinet door (2) that are made of an electrically conductive metal, wherein an LED luminous body is disposed in the cabinet door (2); at least two electrically conductive hinges (3) for enabling the cabinet door (2) to rotate relative to the cabinet body (1) are disposed between the cabinet door (2) and the cabinet body (1), at least one of the hinges (3) is connected to a negative electrode of the LED luminous body, and at least one of the hinges (3) is connected to a positive electrode of the LED luminous body; each of the hinges (3) comprises a first hinge body (31) fixedly connected to the cabinet body (1) and a second hinge body (32) fixedly connected to the cabinet door (2); the first hinge body (31) is connected to a first electrically conductive wire (4) connecting the first hinge body (31) to a power supply; a first outer insulation pad (5) is disposed between the first hinge body (31) and the cabinet body (1); the second hinge body (32) is connected to a second electrically conductive wire (6) connecting the second hinge body (32) to the LED luminous body, and a second outer insulation pad (7) is disposed between the second hinge body (32) and the cabinet door (2).

2. The metal cabinet according to claim 1, wherein a second electrically conductive sheet (8) connecting to the second electrically conductive wire (6) is disposed in the cabinet door (2), a second inner insulation pad (9) is disposed between the second electrically conductive sheet (8) and the cabinet door (2), the second hinge body (32) is connected to the second electrically conductive sheet (8) through a second fixing screw (10), the second fixing screw (10) passes through the second outer insulation pad (7), the cabinet door (2) and the second inner insulation pad (9), and the second fixing screw (10) and the cabinet door (2) are in non-contact state.

3. The metal cabinet according to claim 2, wherein an annular second wire ear (11) is disposed to an end of the second electrically conductive wire (6), the second wire ear (11) is connected to the second electrically conductive sheet (8) through a second electrically conductive screw (12), the second electrically conductive screw (12) passes through the second outer insulation pad (7), the cabinet door (2), the second inner insulation pad (9), the second electrically conductive sheet (8) and the second wire ear (11) the second electrically conductive screw (12) and the cabinet door (2) are in non-contact state, and a second electrically conductive nut (13) is engaged with an end of the second electrically conductive screw (12) to lock the second electrically conductive sheet (8) and the second wire ear (11).

4. The metal cabinet according to claim 2, wherein a plurality of second bulges (14) passing through the cabinet door (2) are defined at a side of the second outer insulation pad (7) and are integrally formed with the second outer insulation pad (7); and the second fixing screw (10) and the second electrically conductive screw (12) are inserted into the second bulges (14) respectively.

5. The metal cabinet according to claim 1, wherein a first electrically conductive sheet (15) connecting to the first electrically conductive wire (4) is disposed in the cabinet body (1), and a first inner insulation pad (16) is disposed between the first electrically conductive sheet (15) and the cabinet body (1); the first hinge body (31) is connected to the first electrically conductive sheet (15) through a first fixing screw (17), the first fixing screw (17) passes through the first outer insulation pad (5), the cabinet body (1) and the first inner insulation pad (16); and the first fixing screw (17) and the cabinet body (1) are in non-contact state.

6. The metal cabinet according to claim 5, wherein an annular first wire ear (18) is disposed to an end of the first electrically conductive wire (4), the first wire ear (18) is connected to the first electrically conductive sheet (15) through a first electrically conductive screw (19), the first electrically conductive screw (19) passes through the first outer insulation pad (5), the cabinet body (1), the first inner insulation pad (16), the first electrically conductive sheet (15) and the first wire ear (18), the first electrically conductive screw (19) and the cabinet body (1) are in non-contact state, and a first electrically conductive nut (20) is engaged with an end of the first electrically conductive screw (19) to lock the first electrically conductive sheet (15) and the first wire ear (18).

7. The metal cabinet according to claim 6, wherein a plurality of first bulges (21) passing through the cabinet body (1) are defined at a side of the first outer insulation pad (5) and are integrally formed with the first outer insulation pad (5), and the first fixing screw (17) and the first electrically conductive screw (19) are inserted into the first bulges (21) respectively.

8. The metal cabinet according to claim 5, wherein a glass mirror is disposed to the cabinet door (2).

* * * * *